United States Patent [19]

Igashira et al.

[11] 4,357,927

[45] Nov. 9, 1982

[54] IGNITION DEVICE FOR A MULTI-CYLINDER INTERNAL COMBUSTION ENGINE

[75] Inventors: Toshihiko Igashira, Toyokawa; Hisasi Kawai, Toyohashi; Ken Nomura, Okazaki, all of Japan

[73] Assignee: Nippondenso Co., Ltd., Kariya, Japan

[21] Appl. No.: 279,708

[22] Filed: Jul. 2, 1981

[30] Foreign Application Priority Data

Jul. 7, 1980 [JP] Japan ..... 55-91636
Nov. 25, 1980 [JP] Japan ..... 55-164610

[51] Int. Cl.[3] ..... F02P 3/04; F02P 7/06

[52] U.S. Cl. ..... 123/622; 123/146.5 A; 123/655; 200/19 DC; 200/19 DR

[58] Field of Search ..... 123/146.5 A, 621, 622, 123/633, 640, 655; 200/19 R, 19 DR, 19 DC, 21

[56] References Cited

U.S. PATENT DOCUMENTS 1,262,544 4/1918 Moses ..... 200/21
1,935,610 11/1933 Beeh et al. ..... 200/21 X
1,978,696 10/1934 Davis, Jr. ..... 200/21
3,910,247 10/1975 Hartig ..... 123/655

*Primary Examiner*—Tony M. Argenbright
*Attorney, Agent, or Firm*—Cushman, Darby & Cushman

[57] ABSTRACT

An ignition device for a multi-cylinder internal combustion engine having an ignition coil, also positive and negative high voltages being alternately generated across the secondary winding of the ignition coil, and a distributor, the distributor comprising a center electrode, two electrical distributing conductors in the rotor of the distributor, the center electrode being connected electrically with the two electrical distributing conductors, the electrical distributing conductors including at least one center conductor and two projecting conductors for distributing electric power to side electrode, two diodes having opposite polarities being connected between the center conductor and the projecting conductors for electrical distribution, respectively, and a plurality of side electrodes adapted to be electrically coupled successively with the projecting conductors according to the rotation of the rotor, whereby positive and negative high voltages are supplied alternately to the side electrodes through the corresponding projecting conductors.

10 Claims, 9 Drawing Figures

No.1
No.5
No.3
No.6
No.2
No.4
37
WAVEFORM SHAPING CCT
MAGNETIC DETECTOR
FF
CL
D
R
Q
Q̄
A
B
C
D
1a
1b
20
21
22
23
24
25
26
27
28
29
30
31
32
33
34
34a
34b
34c
35
36
1
3
4
5
6
7
8
9
12
13
14
15
16
17

IGNITION DEVICE FOR A MULTI-CYLINDER INTERNAL COMBUSTION ENGINE

BACKGROUND OF THE INVENTION

1. Field of the Invention

The present invention relates to an ignition device for a multi-cylinder internal combustion engine.

2. Description of the Prior Art

In order to obtain a good drivability and obtain a desired fuel performance, it is necessary to match exactly the ignition timing for cylinder positions of an engine. If the ignition timing in the cylinder can adapt perfectly during all kinds of driving conditions, then the earliest igniting position will be approximately 60 degrees before top dead center and the last igniting position will be approximately 40 degrees after top dead center in the rotary angle of a crankshaft. Accordingly a distributor must secure the electrical connection between the center electrode and one of the side electrodes within 100 degrees in the rotary angle of the crankshaft i.e. 50 degrees in the rotary angle of a distributor shaft or cam shaft.

When an internal combustion engine has six cylinders, the six side electrodes are required to be equally spaced from each other and the disconnecting intervals between the rotor and each side electrode is only 10 degrees (360/6-50=10) in the angle of the distributor shaft.

When an internal combustion engine has eight cylinders, the disconnecting interval does not exist. In this case the possibility of simultaneous connection across two side electrodes by the rotor arises, and if a high voltage for a spark is applied to the rotor in this case, the high voltage does not determine the supply to either side electrodes. Accordingly the cylinder generating the spark for ignition is not determined alternatively, thus the internal combustion engine cannot operate smoothly. In the case of six cylinders, when the pitch circles of the side electrodes are not large in diameter, the intervals corresponding to the angle of 10 degrees of the distributor shaft is not so large and also the cylinder generating the spark is not determined. The above mentioned spark which is not distributed appropriately and is generated at undesirable positions, and is called a flashover. In order to prevent flashover, in the above mentioned circumstances, the pitch circles of the side electrodes i.e. the outer diameter of the distributor, must be either made larger or the non optimum ignition timing will undesirably continue.

According to the above mentioned reasons, methods by which an engine has two distributors and each distributor supplied a high voltage to half the cylinders, respectively, and by which basically two distributors have a common rotor shaft and are unified, are being experimentally examined. However, the method employing two distributors has defects requiring double the production cost and requiring a wider space. Although the method using a common rotor shaft has a spatial advantage the method needs two ignition coils, thus the method has the disadvantage of a high production cost. Moreover, the incorporating of the two distributors into the construction becomes a complicated structure, thus because of the fault flashover is generated easily and frequently.

The present invention has been proposed in order to solve the above mentioned problems inherent in the conventional methods.

The above mentioned conventional ignition device has been disclosed in Japanese Patent Application No. 85036/74 (Japanese Patent Laid-Open No. 43327/75).

SUMMARY OF THE INVENTION

The principal object of the present invention is to provide an ignition device for a multi-cylinder internal combustion engine preventing flashover in the distributor and being constructed with compact structure by using a distributor with a center electrode and an ignition coil.

Another object of the present invention is to provide an ignition device for a multi-cylinder internal combustion engine arranging two diodes easily and compactly in the rotor of the distributor.

According to the present invention, there is provided an ignition device for a multi-cylinder internal combustion engine having an ignition coil, the two primary windings of the ignition coil being wound in opposite directions from each other, the positive and negative high voltages being alternately generated across the secondary winding of the ignition coil, and a distributor, said distributor comprising a center electrode; two electrical distributing conductors in the rotor of said distributor, the center electrode being connected electrically with the two electrical distributing conductors, the electrical distributing conductors including at least one center conductor and two projecting conductors for distributing electric power to side electrodes; two diodes having opposite polarities from each other and connecting the center conductor with the projecting conductors for electrical distribution, respectively, and; a plurality of side electrodes adapted to be electrically coupled successively with the projecting conductors according to the rotation of the rotor; whereby positive and negative high voltages are supplied alternately to the side electrodes through the corresponding projecting conductors.

DESCRIPTION OF THE PREFERRED EMBODIMENTS

Figure 1:
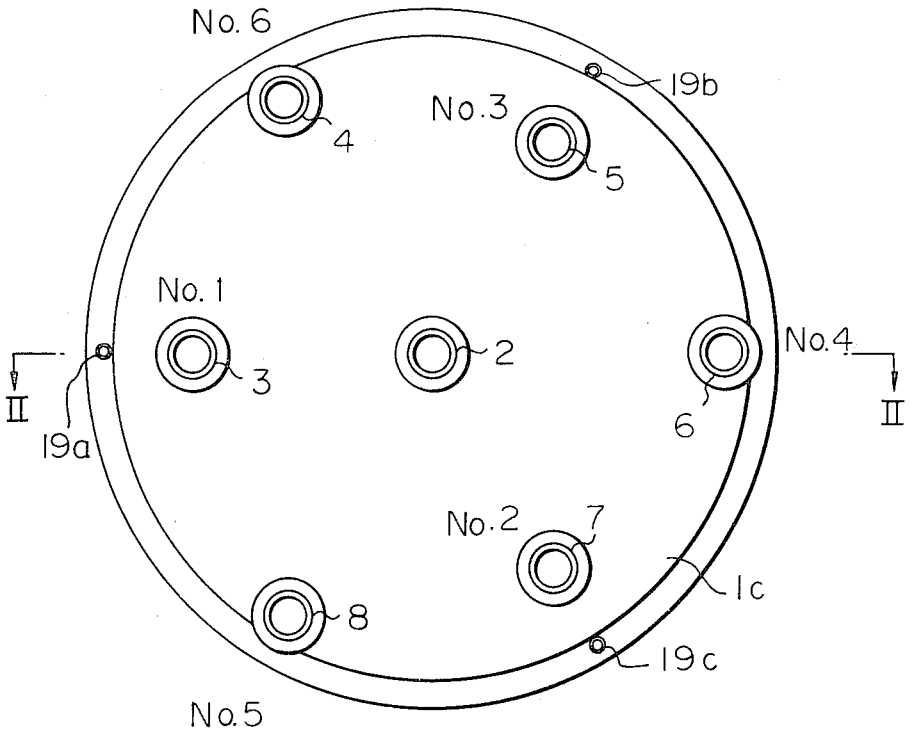
FIG. 1 is a plan view illustrating the distributor used in the ignition device for a multi-cylinder internal combustion engine according to a first embodiment of the present invention.
Figure 2:
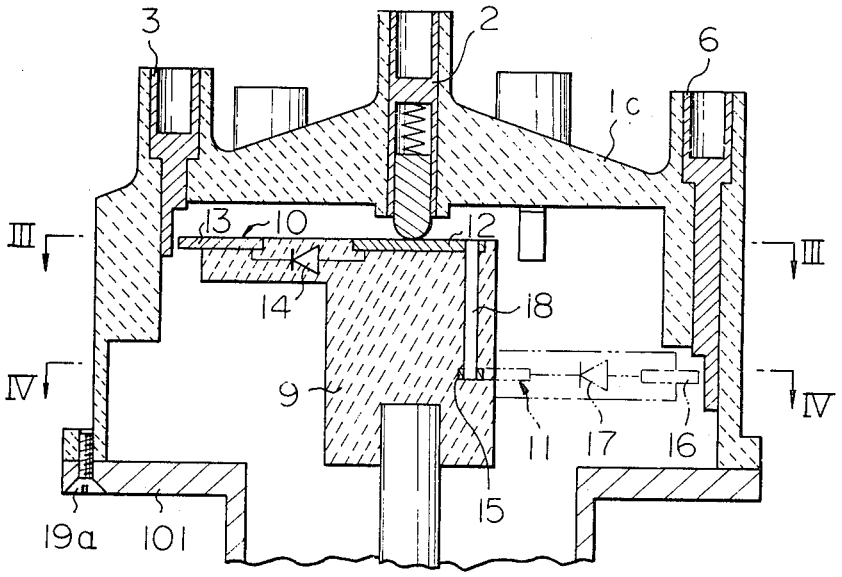
FIG. 2 is a cross-sectional view taken in the direction of the arrows along the line II—II of the distributor shown in FIG. 1.
Figure 3:
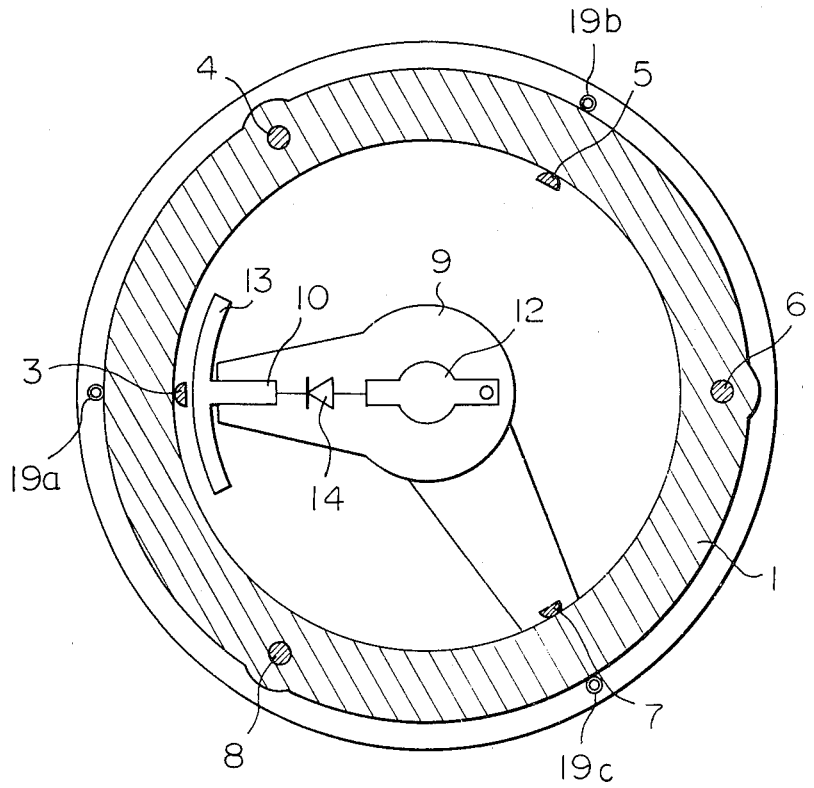
FIG. 3 is a cross-sectional view taken in the direction of the arrows along the line III—III of the distributor shown in FIG. 2.
Figure 4:
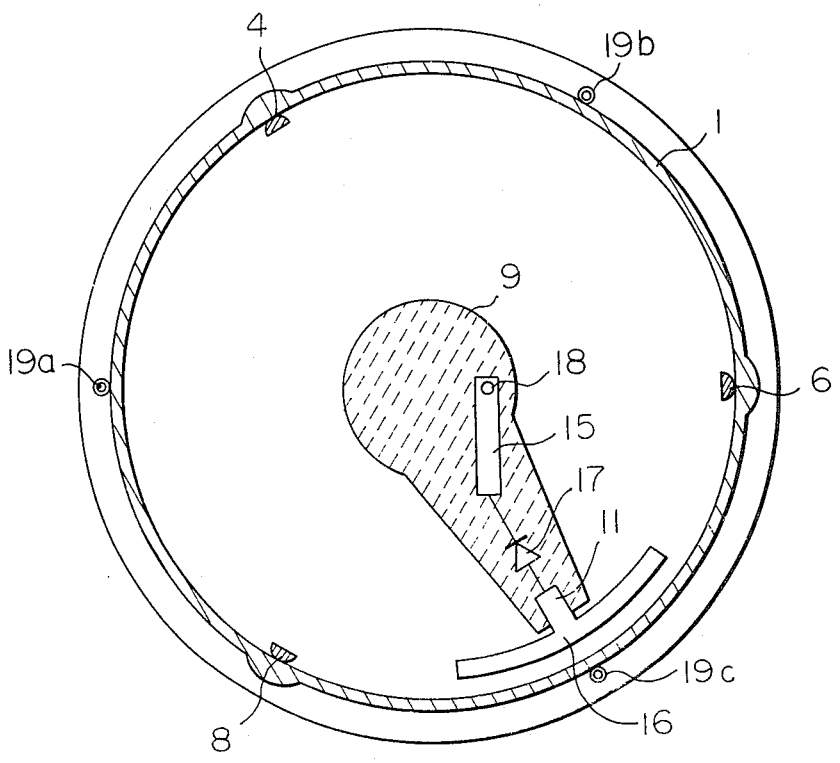
FIG. 4 is a cross-sectional view taken in the direction of the arrows along the line IV—IV of the distributor shown in FIG. 2.

A distributor used in an ignition device for a multi-cylinder internal combustion engine according to a first embodiment of the present invention, is shown in FIGS. 1 through 4. The distributor shown in the embodiment is a distributor used for a six-cylinder internal combustion engine.

In a distributor cap 1*c*, a center electrode 2 and six side electrodes 3, 4, 5, 6, 7 and 8 are provided. The side electrodes 3, 5 and 7 are arranged at an equal distance from the center electrode 2. Similarly the side electrodes 4, 6 and 8 are arranged at an equal distance from the center electrode 2. The distance between the center electrode 2 and any one of the side electrodes 4, 6 and 8, is longer than the distance between the center electrode 2 and any one of side electrodes 3, 5 and 7.

The side electrode 3 is connected with a spark plug in the number 1 cylinder, the side electrode 4 is connected with a spark plug in the number 6 cylinder, the side electrode 5 is connected with a spark plug in the number 3 cylinder, the side electrode 6 is connected with a spark plug in the number 4 cylinder, the side electrode 7 is connected with a spark plug in the number 2 cylinder, and the side electrode 8 is connected with a spark plug in the number 5 cylinder respectively through a high tension cord not shown in the drawings.

Conductors of the side electrodes are molded into the distributor cap 1*c* and are exposed to the inner direction and the outer direction of the distributor cap 1*c*. The outer exposed parts of the conductors are connected with the high tension cords and the inner exposed parts of the conductors are connected electrically with the electrical distributing conductors on the rotor 9 periodically. The electrical distributing conductors on the rotor 9 are arranged at the upper and lower part of the rotor 9, and the electrical distributing conductor 10 at upper part of the rotor corresponds to the side electrodes 3, 5 and 7, and the electrical distributing conductor 11 at the lower part of the rotor corresponds to the side electrodes 4, 6 and 8.

The electrical distributing conductor consists of a center portion and an end portion. The end portion of the electrical distributing conductor is the projecting conductor for electrical distribution. The center portion is connected with the end portion through a diode. In the electrical distributing conductor 10 at the upper portion on the rotor, the center portion 12 is connected with the end portion 13 through the diode 14, which is connected so that the electric current can flow from the center portion 12 to the end portion 13. The end portion 13 of the electrical distributing conductor is made in the form of T, and the central angle of the arc of the T type portion at the distributor shaft is 50 degrees. The end portion 13 is faced opposite the side electrodes 3, 5 and 7 successively according to the rotation of the rotor 9 and the high voltage can be supplied during the interval corresponding to the angle of 50 degrees at the distributor shaft.

In the electrical distributing conductor 11 at the lower portion on the rotor, the center portion 15 is connected with the end portion 16 through the diode 17, which is connected so that the electric current can flow from the end portion 16 to the center portion 15. Similarly the end portion 16 is made in the form of T, and the central angle of the arc of the T type portion at the distributor shaft is 50 degrees. The central angle between the conductor of the end portion 13 and the conductor of the end portion 16 at the distributor shaft is 120 degrees. The rotary radius of the electrical distributing conductor 11 at the lower portion is longer than the rotary radius of the electrical distributing conductor 10 at the upper portion. The center portion 12 in the electrical distributing conductor at the upper portion on the rotor, is coupled with the center portion 15 in the electrical distributing conductor at the lower portion on the rotor through a conductor 18.

The rotor 9 is molded from a high voltage resistant resin and the center portion 12, the end portion 13 and the diode 14 in the electrical distributing conductor at the upper portion on the rotor, the center portion 15, the end portion 16 and the diode 17 in the electrical distributing conductor at the lower portion on the rotor, and the conductor 18 are molded and fixed in the resin.

The lower portion of the rotor 9 is fixed to a shaft of the distributor and the shaft is driven with a half rotary velocity of a crankshaft in an internal combustion engine synchronizing with the rotation of the crankshaft. On the upper end portion of the rotor 9, the center portion 12 of the electrically distributing conductors is exposed, the exposed surface is contacted with a carbon brush in the center electrode 2 and the exposed surface and the carbon brush are connected to each other through sliding contact. The high voltage, the phase of which inverts alternately, is supplied for the center electrode from the external ignition circuit. The distributor cap 1*c* is fixed to a distributor body 101 with screws 19*a*, 19*b* and 19*c*.

Figure 5:
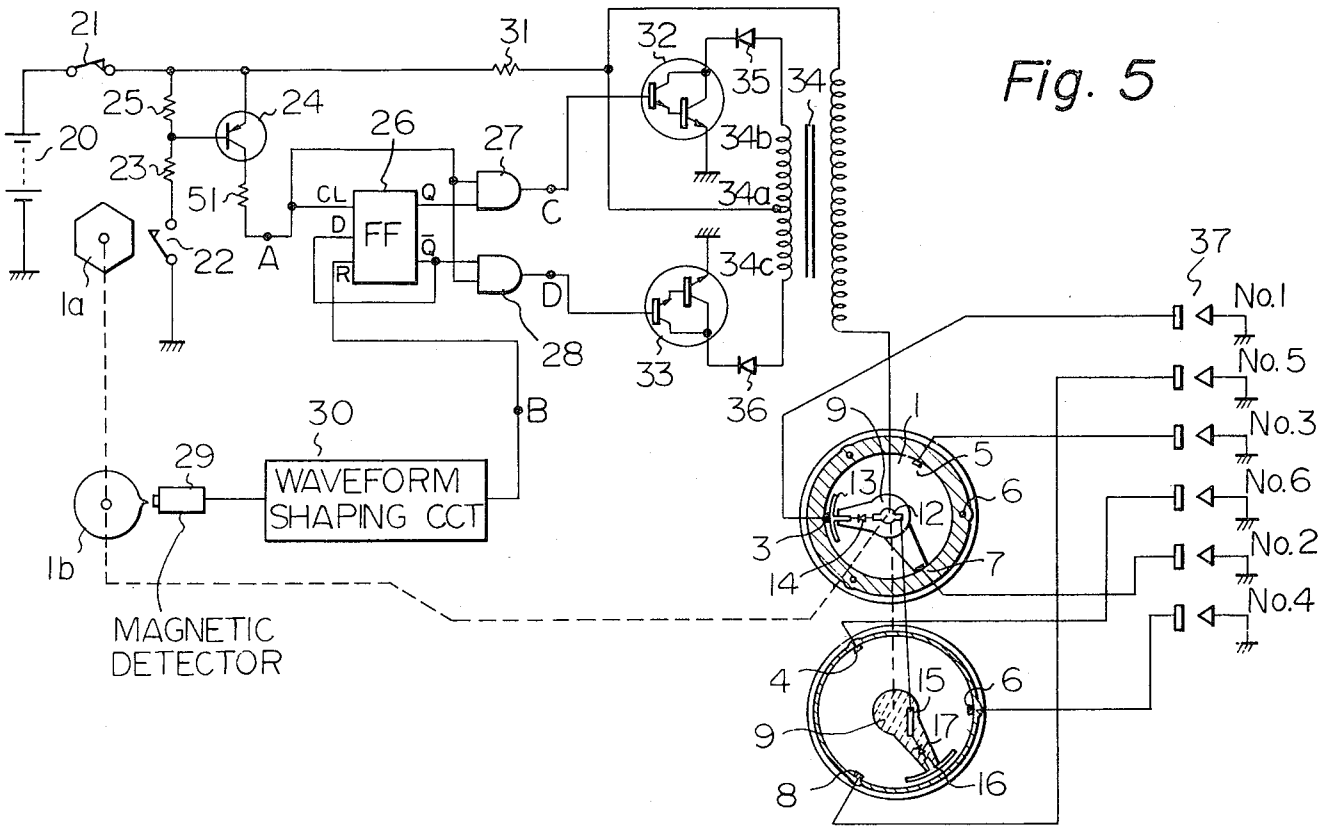
FIG. 5 is a circuit diagram of the ignition device for the multi-cylinder internal combustion engine according to a first embodiment of the present invention.

An ignition circuit of the ignition device for a multi-cylinder internal combustion engine according to the first embodiment of the present invention is shown in FIG. 5. A distributor assembly 1 is for six cylinders and rotates coaxially with (i) a cam 1*a* which opens and closes breaker contacts 22, (ii) a reference position indicating disk 1*b* and (iii) the rotor. The negative pole of a battery 20 is grounded. One terminal of a key switch 21 is connected with the positive pole of the battery 20. One of the breaker contacts 22 which are accommodated in the distributor 1 is grounded and the other breaker contact is connected with one terminal of a resistor 23. The other terminal of the resistor 23 is connected with the base of a PNP transistor 24. The emitter of the transistor 24 is connected with the other terminal of the key switch 21. A resistor 25 is connected between the emitter and the base of the transistor 24. The collector of the transistor 24 is connected with one terminal of a resistor 51 and the other terminal of the resistor 51 is connected with the clock signal input terminal of a D-flip-flop circuit, one input terminal of an AND gate 27 and one input terminal of an AND gate 28, respectively.

A model number CD4013, made by Radio Corporation of America, for example, is used as the D-flip-flop and the D-input terminal of the D-flip-flop is connected with the $\overline{Q}$ output of the same. Thus the D-flip-flop 26 is operated as a flip-flop circuit. The Q output of the D-flip-flop 26 is connected with the other input terminal of the AND gate 27 and the $\overline{Q}$ output of the D-flip-flop 26 is connected with the other input terminal of the AND gate 28. The disk 1*b* is a circular plate rotating a revolution according to one revolution of the distributor 1 and is made of ferromagnetic material. The disk 1*b* has a projection. A magnetic detector 29, which is on the market and is well known, is used to generate an electric signal whenever the projecting portion of the disk 1*b* passes through. A waveform shaping circuit 30 is connected with the output terminal of the magnetic detector 29 and the signal of the magnetic detector 29 is formed by the waveform shaping circuit 30. The output terminal of the waveform shaping circuit 30 is connected with the reset terminal of the D-flip-flop 26.

The output terminal of the AND gate 27 is connected with the base of a power transistor 32 and the output terminal of the AND gate 28 is connected with the base of a power transistor 33.

A resistor 31 is used to limit the electric current and one terminal of the resistor 31 is connected with a terminal of a key switch 21 and the other terminal of the resistor 31 is connected with the intermediate terminal 34*a* of the primary coil of the ignition coil 34 and one terminal of the secondary coil of the ignition coil 34. Another terminal 34*b* of the primary coil of the ignition coil 34 is connected with the collector of the power transistor 32 through a diode 35 and the other terminal 34*c* is connected with the collector of the power transistor 33 through a diode 36. The emitters of the power transistors 32 and 33 are grounded. The other terminal of the secondary coil of the ignition coil 34 is connected electrically with the center portions 12 and 15 of the rotor 9 through the center electrode 2 of the high voltage delivering device in the distributor 1. The arrangement of the center electrode in the high voltage delivering device and diodes referred to the side electrodes is illustrated in FIG. 1 through FIG. 4, therefore in FIG. 5 the illustrations of the arrangement of the same are abbreviated.

The reference numeral of the ignition plug is 37. The specification of the winding between the terminals 34*a* and 34*b* of the primary coil in the ignition coil 34, and the specification of the winding of the secondary coil are similar to the winding specifications of the conventional ignition coil. The specification for the primary winding between the terminals 34*a* and 34*c* is the same as the specification for the primary winding between the terminals 34*a* and 34*b* except that the winding direction is opposite. When electric current is applied between the terminals 34*a* and 34*b* of the primary coil of the ignition coil 34 and then the current is broken off, the positive high voltage generates across the secondary coil. When electric current is applied between the terminals 34*a* and 34*c* of the primary coil and then the current is broken off, a negative high voltage is generated across the secondary coil.

Figure 6:
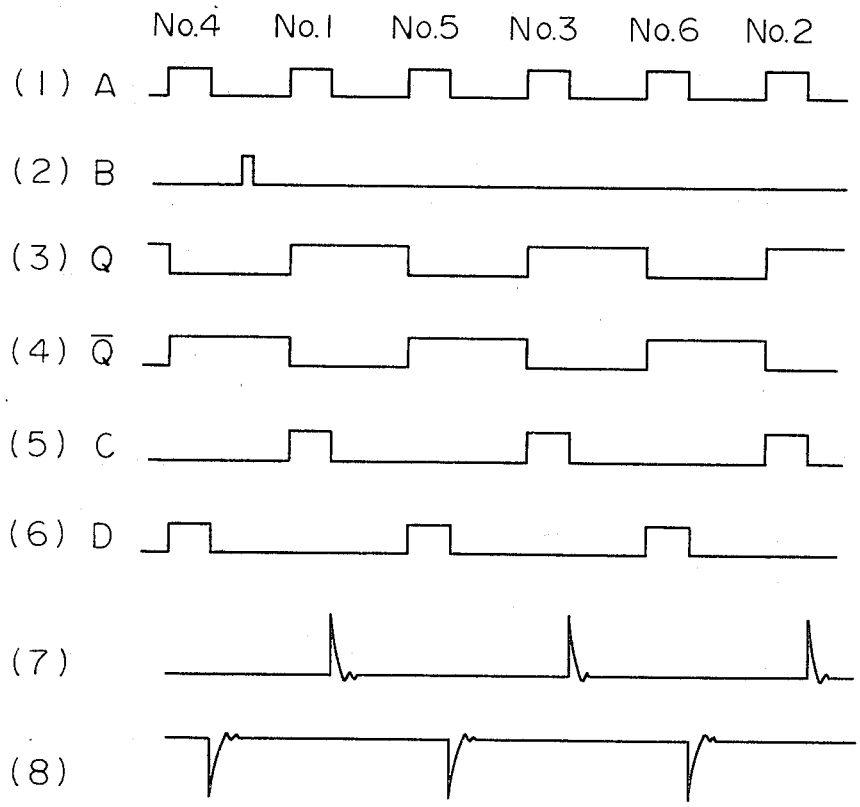
FIG. 6 is a waveform chart showing voltage waveforms at the main points of the circuit shown in FIG. 5.

The operation of the above mentioned ignition circuit will be explained by the following description. At first, the key switch 21 is closed to operate the engine, the cam 1*a* of the distributor 1 is rotated by the operation of the engine, and the breaker contact 22 is closed or opened. When the breaker contact 22 is closed, the transistor 24 conducts and when the breaker contact 22 is opened, the transistor 24 is cut off. The waveform of the current through the transistor 24 is shown in (1) of FIG. 6. Pulses shown in (2) of FIG. 6 are generated at the output of the waveform shaping circuit 30 by the rotation of the reference position indicating disk 1*b*. The output terminals Q and $\overline{Q}$ of the D-flip-flop 26 generate the output voltages having waveforms shown in (3) and (4) of FIG. 6, respectively. Thus, the waveform shown in (5) of FIG. 6 is obtained at the output terminal of the AND gate 27, and the waveform shown in (6) of FIG. 6 is obtained at the output terminal of the AND gate 28. When the output voltage of the AND gate 27 is high level, the power transistor 32 conducts and when the output voltage of the AND gate 27 is low level, the power transistor 32 is cut off. As similar to the operations of the power transistor 32, when the output voltage of the AND gate 28 is high level, the power transistor 33 is conducted and when the output voltage of the AND gate 28 is low level, the power transistor 33 is cut off.

When the power transistor 32 conducts and then the power transistor 32 is cut off, a positive high voltage is generated across the secondary coil as shown in (7) of FIG. 6, and when the power transistor 33 conducts and then the power transistor 33 is cut off, a negative high voltage is generated across the secondary coil as shown in (8) of FIG. 6. The diode 35 prevents the power transistor 32 from breaking down because of the high voltage across the primary coil when the power transistor 33 is cut off. The diode 36 prevents the power transistor 33 from breaking down because a high voltage is generated across the primary coil when the power transistor 32 is cut off.

As explained above, the high voltage which is generated across the secondary coil in the ignition coil 34, is distributed to ignition plugs in each cylinder of the engine through distributing portions in the distributor 1. However, since in the middle portion between the center portion 12 and the end portion 13 of the rotor 9, the high withstanding voltage diode is arranged, the polarity of which is directed to the anode for the center portion 12 and the cathode for the end portion 13, and in the middle portion between the center portion 15 and the end portion 16, the high withstanding voltage diode 17 is arranged, the polarity of which is directed to the cathode for the center portion 15 and the anode for the end portion 16, thus only the positive high voltage is transmitted to the end portion 13 of the rotor 9 and only a negative high voltage is transmitted to the end portion 16. Thus, when the power transistor 32 operates, the ignition plugs of the first, the third and the second cylinders can spark and discharge, and while the power transistor 33 operates, the ignition plugs of the fifth, the sixth and the fourth cylinders can spark and discharge.

As mentioned above, each cylinder in the internal combustion engine is ignited securely in the order of No. 1, No. 5, No. 3, No. 6, No. 2 and No. 4.

The ignition device for a multi-cylinder internal combustion engine according to the first embodiment of the present invention comprises the distributing portions which consist of upper and lower portions in the rotor of the distributor 1, and in both upper and lower portions, two diodes, the polarities of which are mutually opposite. Since the high voltage which is inverted alternately in the phase thereof, is supplied to the common portion of the upper and lower portions, the high voltage supplying paths are switched alternately from upper portion to lower portion or vice versa, therefore the distance between the adjacent side electrodes can be long and flashover can be prevented. Moreover the outer diameter of the distributor can be small and the only one ignition coil is sufficient for this purpose.

Figure 7:
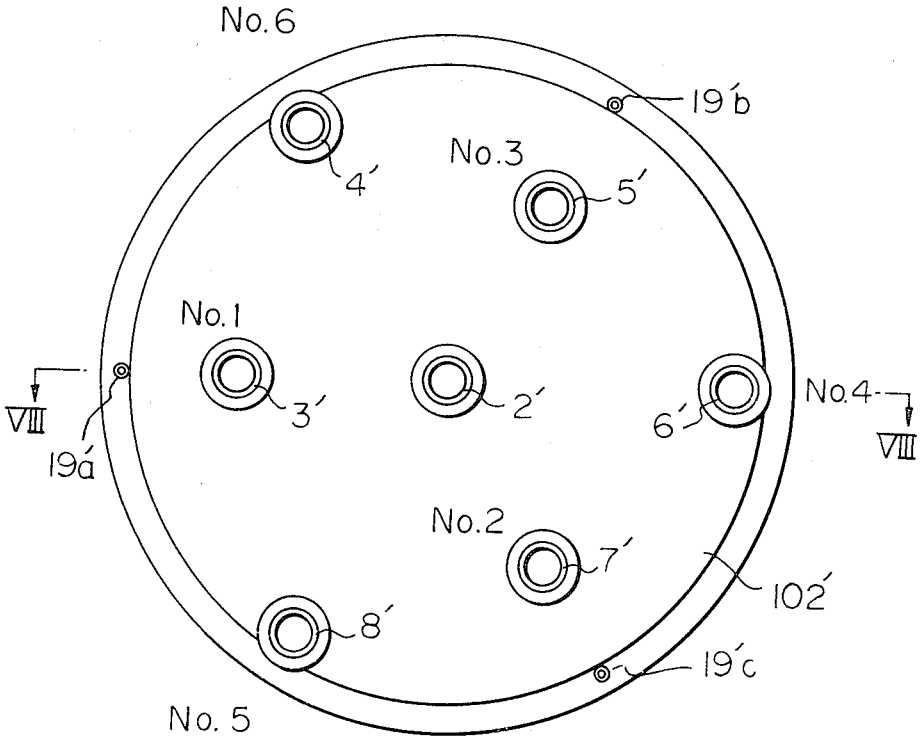
FIG. 7 is a plan view illustrating the distributor used in the ignition device for a multi-cylinder internal combustion engine according to a second embodiment of the present invention.
Figure 8:
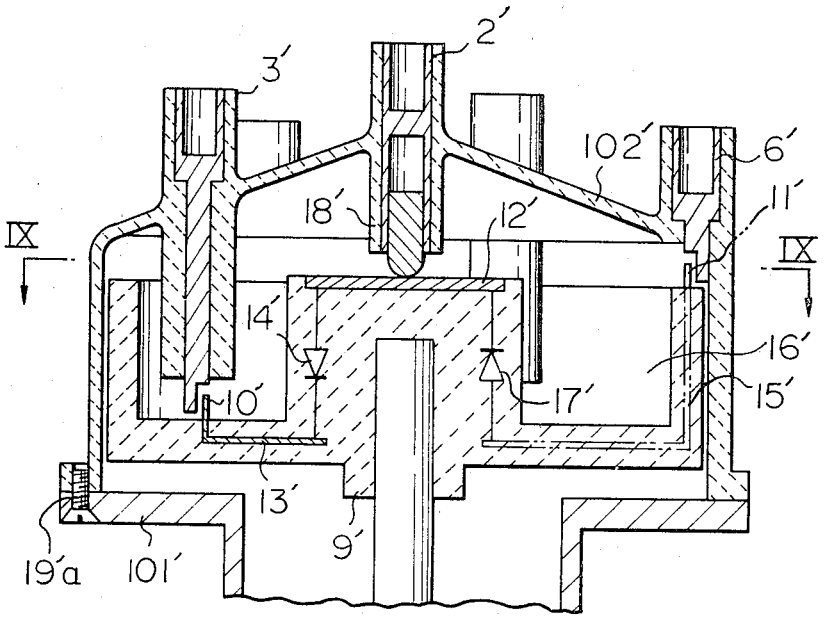
FIG. 8 is a cross-sectional view taken in the direction of the arrows along the line VIII—VIII of the distributor shown in FIG. 7.
Figure 9:
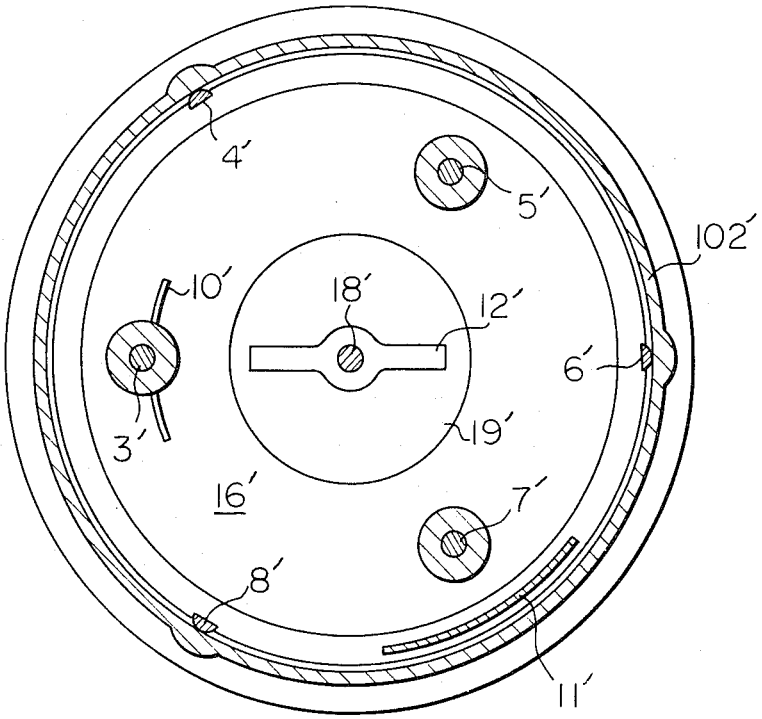
FIG. 9 is a cross-sectional view taken in the direction of the arrows along the line IX—IX of the distributor shown in FIG. 8.

A distributor used in the ignition device of a multi-cylinder internal combustion engine according to the second embodiment of the present invention is shown in FIGS. 7 through 9. The distributor is used for an internal combustion engine having six cylinders. In a distributor cap 102', a center electrode 2' and six side electrodes 3', 4', 5', 6', 7' and 8' are provided. The side electrodes 3', 5' and 7' are arranged on a small circle and the side electrodes 4', 6' and 8' are arranged on a large circle, and the centers of both circles are identical with the position of the center electrode 2'. The side electrodes 3', 4', 5', 6', 7' and 8' are connected with ignition plugs of No. 1, No. 6, No. 3, No. 4, No. 2 and No. 5 cylinders respectively, by high tension cords (not shown). Conductors of the side electrodes are partly molded in the distributor cap 102' and exposed inwardly and outwardly from the distributor cap 102'. The outwardly exposed portions are connected with high tension cords and the inwardly exposed portions are connected electrically with brushes of a rotor 9 periodically. The conductors of the side electrodes 3', 5' and 7' are longer than the conductors of the side electrodes 4', 6' and 8', and are exposed on the inner side of the distributor cap 102' at a more downward projected position than the conductors of the side electrodes 4', 6' and 8'. Accordingly, the brushes of the rotor 9' consist of an upper brush 11' corresponding to the side electrodes 4', 6' and 8', and a lower brush 10' corresponding to the side electrodes 3', 5' and 7'.

Distributing conductors which are molded in the rotor 9', comprise two arms 13' and 15', the exposed portions of which form brushes, and a center conductor 12' which supplies high voltage directly from the center electrode 2'. The arms are connected with the center conductor through diodes 14' and 17'. The arm 13', having the lower brush 10', is connected with the center conductor 12' through diode 14', the anode of which is directed towards the center conductor 12'. The arm 15', having the upper brush 11', is connected with the center conductor 12' through diode 17', the cathode of which is directed towards the center conductor 12'. The rotor 9' is made in the form of a disk and has a concentric recess 16' on the upper surface. In the recess 16' the conductors of the side electrodes are projected and exposed. The arm 13' is projected on the bottom of the recess 16' of the rotor so as to face against the exposed conductors of the side electrodes, and is formed the brush 10'. The brush 10' is made in the form of an arc and exposed upwardly in the recess, and the center angle of the arc measured at the distributor shaft is 50 degrees. The brush 10' is faced against the side electrodes 3', 5' and 7' sequentially, and for the time interval during which the brush is rotating at an angle of 50 degrees and facing against the side electrode, a high voltage can be supplied. At the upper end of the outermost periphery of the rotor 9', the brush 11' is exposed upwardly in the form of an arc and the center angle of the arc measured at the distributor shaft is 50 degrees. The brush 11' is faced against the side electrodes 4', 6' and 8' sequentially, and for the time interval during which the brush is rotating at an angle of 50 degrees and facing against the side electrode, a high voltage can be supplied. The angle between the brushes 10' and 11' is 120 degrees. A body of the rotor 9' is formed of a high voltage resistant resin and the two arms 13' and 15', the center conductor 12' and the two diodes 14' and 17' are molded and fixed into the resin. The rotor 9' is fixed to the shaft of the distributor at the inner portion thereof and the shaft is driven synchronizing with the crankshaft rotation of the internal combustion engine at half the rotation speed of the crankshaft rotation speed. On the upper end of the rotor 9' the center conductor 12' is exposed and the exposed surface is contacted with a carbon brush 18' attached to the center electrode 2' and engages in a sliding manner with each other. The distributor cap 102' is fixed to a distributor body 101' with screws 19'*a*, 19'*b* and 19'*c*. The distributor body 101' is made of metal and fixed to the internal combustion engine, and accommodates the shaft, breaker contacts, a cam and a reference position indicating disk.

An ignition circuit of the ignition device for a multi-cylinder internal combustion engine according to the second embodiment of the present invention is the same as the above described ignition circuit of the first embodiment of the present invention, therefore the explanation thereof is abbreviated. In FIG. 5 the reference numerals of the distributor parts 13, 16 and 15 are revised to be read 10', 11' and 12', respectively. Reference numerals of the other parts of the distributor in FIG. 5 should have added prime reference marks, respectively.

As explained above, the high voltage which is generated across the secondary coil in the ignition coil 34, is distributed to ignition plugs in each cylinder of the engine through a distributing device in the distributor 1'. However since in the middle portion between the center conductor 12' and the brush 10' of the rotor 9', the high withstanding voltage diode 14' is arranged, the polarity of which is directed to the anode for the center conductor 12' and the cathode for the brush 10', and in the middle portion between the center conductor 12' and the brush 11', the high withstanding voltage diode 17' is arranged, the polarity of which is directed to the cathode for the center conductor 12' and the anode for the brush 11', only the positive high voltage is transmitted to the brush 10' of the rotor 9' and only the negative high voltage is transmitted to the brush 11'. Thus, when the power transistor 32 is operated the ignition plugs of the first, the third and the second cylinders can spark and discharge, and when the power transistor 33 is operated the ignition plugs of the fifth, the sixth and the fourth cylinders can spark and discharge.

As mentioned above, each cylinder in the internal combustion engine is ignited securely in the order of No. 1, No. 5, No. 3, No. 6, No. 2 and No. 4.

In the so-called two stage distributor according to the construction shown in FIGS. 7 through 9, the downward projection length of the side electrodes which are arranged on the small circle in the distributor cap is longer than the downward projection length of the side electrodes which are arranged on the large circle, and the ends of the projected side electrodes on the small circle are arranged in the recess which is constructed in the shape of a concentric ring for the cylindrical rotor. Flashover from the side electrodes (3', 5', 7') or from the brush 10' facing the side electrodes to the metallic body 101' must pass through the recess 16' of the rotor, however, it is practically impossible that flashover can pass through a recess having the construction shown in FIGS. 7 through 9.

We claim:

1. An ignition device for a multi-cylinder internal combustion engine having an ignition coil, the two primary windings of said ignition coil being wound in opposite directions from each other, positive and negative high voltages being alternately generated across the secondary winding of said ignition coil, and a distributor, said distributor comprising a center electrode; two electrical distributing conductors in the rotor of said distributor, said center electrode being connected electrically with said two electrical distributing conductors, said electrical distributing conductors including at least one center conductor and two projecting conductors for distributing electric power to side electrode; two diodes having opposite polarities from each other and connecting said center conductor and said projecting conductors for electrical distribution, respectively, and; a plurality of side electrodes adapted to be electrically coupled successively with said projecting conductors according to the rotation of said rotor; whereby said positive and negative high voltages are supplied alternately to said side electrodes through said corresponding projecting conductors.

2. An ignition device as set forth in claim 1, wherein said side electrodes are molded into the distributor cap of said distributor and are arranged on large and small circles centered on said center electrode.

3. An ignition device as set forth in claim 2, wherein said distributing conductors are arranged on upper and lower stages corresponding to said each side electrode which is arranged on said large and small circles.

4. An ignition device as set forth in claim 2, wherein said side electrodes molded into said distributor cap are exposed to inner direction and outer direction of said distributor cap.

5. An ignition device as set forth in claim 1, wherein said projecting conductors of said distributing conductors are made in the form of a T and the angle of said projecting conductor measured from the center of said distributor shaft is approximately 50 degrees.

6. An ignition device as set forth in claim 1, wherein said side electrodes of said distributor cap are arranged on large and small circles, downwardly projecting, and the length of said side electrode arranged on said small circle is longer than said downward projecting length of said side electrode arranged on said large circle, conductors of said side electrodes arranged on said small circle are exposed in a concentric recess of said rotor, and the end portion of an arm is formed of a brush which is projected from the bottom of said recess of said rotor so as to face against said exposed side electrodes.

7. An ignition device as set forth in claim 6, wherein said high voltage the phase of which is inverted alternately is supplied to said center electrode of said distributor cap, said rotor connected directly with said center electrode electrically has two brushes which face against said side electrodes arranged on said large and small circles, respectively, and said two brushes are connected with said center electrode through diodes having different polarities from each other.

8. An ignition device as set forth in claim 6, wherein said distributing conductor comprises an arm, the exposed portion of which is formed of a brush, and center conductor to which high voltage is supplied directly from said center electrode.

9. An ignition device as set forth in claim 6, wherein said rotor is made in the form of a disk, said rotor has a concentric recess opening upwardly and a portion of said conductors of said side electrodes arranged on said small circle is exposed into said recess.

10. An ignition device as set forth in claim 6, wherein said brushes are exposed upwardly in the form of an arc, and the angle of said brush measured from the center of said distributor shaft is approximately 50 degrees.

* * * * *